United States Patent [19]

Grothoff

[11] Patent Number: 4,775,079

[45] Date of Patent: Oct. 4, 1988

[54] UPRIGHT/INVERTED PUMP SPRAYER

[76] Inventor: Hans Grothoff, Pulverstrasse 35, Dortmund, Fed. Rep. of Germany

[21] Appl. No.: 795,248

[22] Filed: Nov. 5, 1985

[51] Int. Cl.[4] ..... B05B 9/43

[52] U.S. Cl. ..... 222/321; 222/376; 222/402.19; 222/481; 239/334

[58] Field of Search ..... 222/372, 376, 382, 402.19, 222/478, 487, 481.5, 482, 383, 385, 321; 239/334, 342

[56] References Cited

U.S. PATENT DOCUMENTS

| | | | |
|---|---|---|---|
| 686,183 | 11/1901 | Yost | 222/385 |
| 1,264,554 | 4/1918 | Peron | 222/385 X |
| 2,013,715 | 9/1955 | Lohse | 222/478 X |
| 2,861,839 | 11/1958 | Mellon | 222/385 X |
| 2,924,360 | 2/1960 | Samuel | 222/376 X |
| 3,379136 | 4/1968 | Corsette | 222/321 X |
| 3,399,811 | 9/1968 | Miller | 222/481 X |
| 3,596,808 | 8/1971 | Corsette | 222/385 X |
| 3,865,313 | 2/1975 | Kondo | 222/383 X |
| 4,019,661 | 4/1977 | Szabo | 222/376 |
| 4,051,983 | 10/1977 | Anderson | 222/321 |
| 4,173,297 | 11/1979 | Pettersen | 222/385 X |
| 4,193,551 | 3/1980 | Saito et al. | 222/383 X |
| 4,216,883 | 8/1980 | Tasaui et al. | 222/321 |
| 4,277,001 | 7/1981 | Nozawa | 222/321 |
| 4,371,098 | 2/1983 | Nozawa et al. | 222/376 X |

FOREIGN PATENT DOCUMENTS 3045565 1/1983 Fed. Rep. of Germany .

*Primary Examiner*—Robert J. Spar
*Assistant Examiner*—P. McCoy Smith
*Attorney, Agent, or Firm*—Michael J. Striker

[57] ABSTRACT

A manually actuated upright/inverted pump sprayer having a piston controlled container vent path, an auxiliary liquid intake port for inverted spray being spaced closer to the inner side of the container seal gasket compared to the spacing of the container vent port therefrom so as to preclude the spontaneous ingestion of air bubbles from the open vent path into the pump chamber through such intake port during inverted spray.

17 Claims, 3 Drawing Sheets

UPRIGHT/INVERTED PUMP SPRAYER

BACKGROUND OF THE INVENTION

This invention relates generally to a pump sprayer capable of dispensing in both upright and inverted positions, and more particularly to such a sprayer which avoids simultaneous ingestion of air into the pump chamber from the container vent passage when operating in an inverted position of the sprayer.

Known pump sprayers are disclosed in German Pat. No. 30 45 565 and in U.S. Pat. No. 4,277,001 as having an auxiliary valve assembly associated with the pump chamber to facilitate inverted spray. Such sprayers typically have a container vent passage which is opened during the piston pressure stroke to admit atmospheric air into the container to replace the liquid being dispensed so as to avoid hydraulic lock within the container by equalizing the pressure therein. In the German Patent, the container vent passage extends through a central opening in the closure cap through which the hollow piston stem extends, through an opening of the pump cylinder and into the container. A depending collar on the closure cap surrounding the central opening is engaged by the pump piston at the end of the piston suction stroke for closing the vent passage, the vent being opened by the pump piston during reciprocation within the pump cylinder.

However, when these sprayers are operated in an inverted or steeply slanted position, air bubbles entering the liquid in the container through the open vent passage during piston reciprocation are suctioned into the pump chamber through the liquid intake port which, especially for fine mist sprayers, is unacceptable. This unwanted air ingested into the pump chamber adversely affects pump priming by reducing the liquid volume of the pump chamber causing a sputtered and uneven spray and dribbles and drips from the discharge orifice at the end of each pressure stroke. And, a sufficient volume of air in the pump chamber can cause the liquid output during pumping to cease almost completely which is totally unacceptable for the largely pharmaceutical and cosmetic applications of these sprayers.

In the aforementioned patented sprayers, for example, the air vent port through which air enters the container, in an upright position of the container, is always above the liquid intake port usually located at the terminal end of the dip tube which extends to the bottom of the container. Conversely, in an inverted position of the sprayer, the air vent port which is controlled by the pump piston is below the liquid intake port such that air bubbles are ingested automatically into the pump chamber during piston reciprocation.

Another disadvantage which is apparent from the aforementioned German patent sprayer is that the liquid intake port is located relatively far from the mouth of the container so that complete removal of the liquid product from the container is inhibited during inverted spray.

Although an upwardly extending liquid intake conduit lies just below the mouth of the container for inverted spray, as in U.S. Pat. No. 4,277,001, such is made possible only for sprayers having an auxiliary valve attached external to the pump cylinder and requires, mreover, a greater effort through additional fastening and coupling components and a more complicated and laborious assembly procedure.

SUMMARY OF THE INVENTION

It is therefore an object of the present invention to provide a pump sprayer for upright and inverted spray which is of uncomplicated construction, easy and economical to manufacture and assemble yet highly effective in avoiding intake of air into the pump chamber through the open container vent during inverted spray, thereby avoiding the pump priming and spraying problems experienced with known sprayers of this type.

Another object of the invention is to provide such a sprayer which assures complete withdrawal of the liquid from the container even when spraying is carried out in an inverted position of the container, but without the need for additional components and with relatively small material and assembly efforts.

A further object of the present invention is to provide such a sprayer as having the pump cylinder and a manually operated piston reciprocable therein so as to therewith define a variable volume pump chamber, valve controlled liquid inlet and outlet passages associated with the pump chamber, a closure cap in engagement with the pump cylinder for mounting it on a container of liquid to be dispensed, a sealing gasket within the cap for sealing against the mouth of the container, a container vent path controlled by the piston upon reciprocation, and an auxiliary valve means associated with the pump chamber which includes an intake port through which liquid is suctioned into the pump chamber in an inverted position of the container. The intake port is spaced a predetermined distance from the underside of the gasket, and the vent path terminates in an air vent port spaced from the underside of the gasket a greater distance compared to that of the intake port, such that in the inverted position of the container air entering through the vent port during suction strokes of the piston is prevented from inletting the pump chamber through the intake port A still further object of this invention is to provide such a sprayer wherein the gasket itself has a vent passage which terminates in the vent port, or the gasket has a sleeve which seals against the cylinder, with the sleee having an axially extending groove defining the vent passage, or the gasket has an axially tube defining the vent passage, or the pump cylinder has an axially extending groove defining the vent passage, or the vent passage is located in the wall of the cylinder.

A still further object of the present invention is to provide such a sprayer wherein the intake port is located closer to the gasket compared to the piston at the end of its suction stroke, in which the intake port is located in the wall of the pump cylinder, at the end of an upstanding conduit, or in the flange of the gasket seal.

Other objects, advantages and novel features of the invention will become more aparent from the following detailed description of the invention when taken in conjunction with the accompanying drawings.

DETAILED DESCRIPTION OF THE INVENTION

Figure 1:
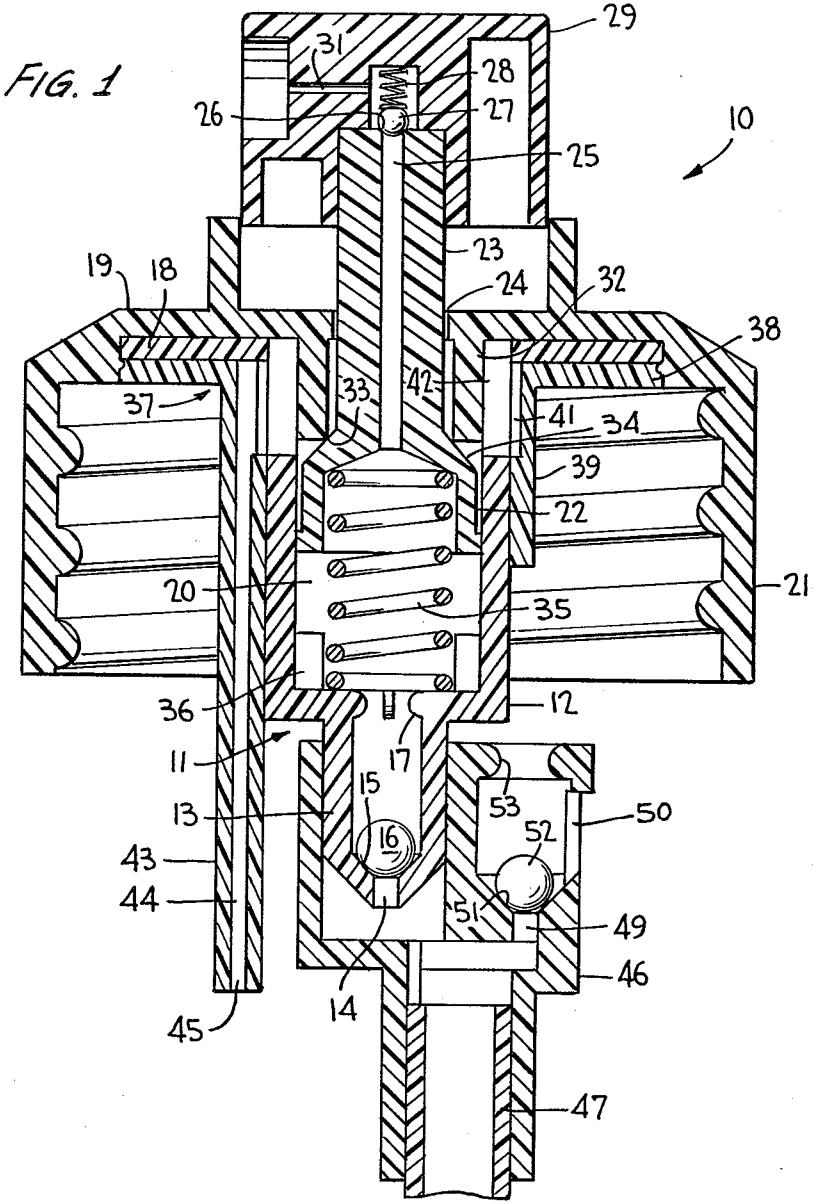
FIG. 1 is a longitudinal sectional view of a manually operated sprayer according to the invention, capable of upright and inverted spray, and with an auxiliary valve located external to the pump cylinder.

Turning now to the drawings wherein like reference characters refer to like and corresponding parts throughout the several views, a manually operated sprayer is generally designated 10 in FIG. 1, this sprayer having a basic structure similar to that of the German No. 30 45 565 patent. The pump sprayer comprises a pump housing 11 which includes a pump cylinder 12 having a depending hollow nipple 13 with an inlet opening 14 at its lower end surrounded by a conical, or the like, valve seat 15. An inlet ball check valve 16 is supported on the valve seat in an inlet closing position, the ball valve being raised from its valve seat in an inlet opening position and being limited in an upward direction by nibs 17 defining ball stops.

Housing 11, which is open at its upper end, has a laterally extending flange 18 supported within upper end 19 of an internally threaded closure cap 21. Flange 18 may be mounted under the cap in any normal manner, and the cap may instead be internally shaped so as to be snap fitted onto the bottle neck of a container (such as C of FIG. 2) of liquid to be dispensed.

A pump piston 22 is disposed within the cylinder for reciprocation and therewith defines a variable volume pump chamber 20, the piston having a hollow stem 23 extending outwardly through a central opening 24 located in the uper end of the closure cap and therewith defining an annular gap. The hollow stem has a discharge passage 25 formed therein terminating in a valve seat 26 which supports a discharge ball check valve 27 spring biased into its closed position by a small coil spring 28. This spring is contained within a discharge head 29 in engagement with the piston stem and having a discharge orifice 31 communicating with the discharge passage when valved open for discharging a liquid product in the form of a spray.

Upper end 19 of the closure cap has a short depending sleeve 32 surrounding central opening 24, the lower inner edge 33 of the sleeve forming a valve seat engaged by a conical section 34 of the pump piston. The piston is biased into its position shown in FIG. 1 by a coil return spring 35 supported at its lower end within a plurality of stops 36 and at its upper end within the hollow of the pump piston.

A gasket seal 37 of elastomeric material, has a lateral flange 38 at its upper end supported against flange 18 within the upper end of the closure cap and may be mounted thereto in any normal manner. Flange 38 seals against the mouth of the container as in any normal manner.

The gasket seal has a depending skirt 39 in sealing engagement along the entire periphery of the pump cylinder, and has an enlarged inner diameter portion forming an annular groove 41. At least one opening 42 is provided in the wall of the pump cylinder juxtaposed to groove 41 of the gasket. And, the gasket has an axial hollow tube 43 with an internal passage 44 terminating in a vent port 45 within the container and opening at its upper end into groove 41 and slot 42. Thus, a container vent path is defined by a clearance space between piston stem 23 and opening 24, through slot 42, portion 41 and passage 44 into the container.

An auxiliary valve housing 46 supports a dip tube 47 extending into the container, the auxiliary valve housing being mounted externally of the pump housing on nipple 13 as shown. A tubular sleeve 48 of the auxiliary valve housing has a bore 49 surrounded by a conical valve seat 51 supporting a ball check valve 52, sleeve 48 having a narrow slot 50 in its wall of a width less than the diameter of ball 52. And, sleeve 48 forms a cage for ball 52, and is constricted as at 53 for retaining the unseated ball valve 52 therewithin. As will be described, slot 50 defines an intake port during inverted spray.

During operation of the pump sprayer in the upright position shown, the plunger head is manually reciprocated such that, during the pressure stroke, liquid within the pump chamber is pressurized, opens valve 27 for effecting of spray discharge, and during the ensuing suction stroke reduced pressure within the pump chamber unseats valve 16 such that the product is suctioned into the pump chamber through the dip tube and inlet opening 14. As section 34 of the piston moves away from its valve seat 33 during pump reciprocation, the container vent path is opened for equalizing the pressure within the container.

In an inverted position of the container mounted pump sprayer, or in a steeply slanted position thereof, and assuming that the liquid within the container covers slot 50, dispensing is carried out during the pressure stroke in the same manner as during upright spray. However, during the suction stroke, ball valve 16 is raised from its seat by the reduced pressure within the pump chamber, ball valve 52 falls by gravity within its cage, and liquid product is suctioned through slot 50, intake port 49 and into the pump chamber through the open inlet valve. However, since vent port 45 extends beyond inlet slot 50 of the auxiliary valve, air bubbles from the open vent path are prevented from being suctioned into the pump chamber through slot 50, and ports 49, 14 simultaneously with a suctioning of liquid product therethrough into the pump chamber.

Figure 2:
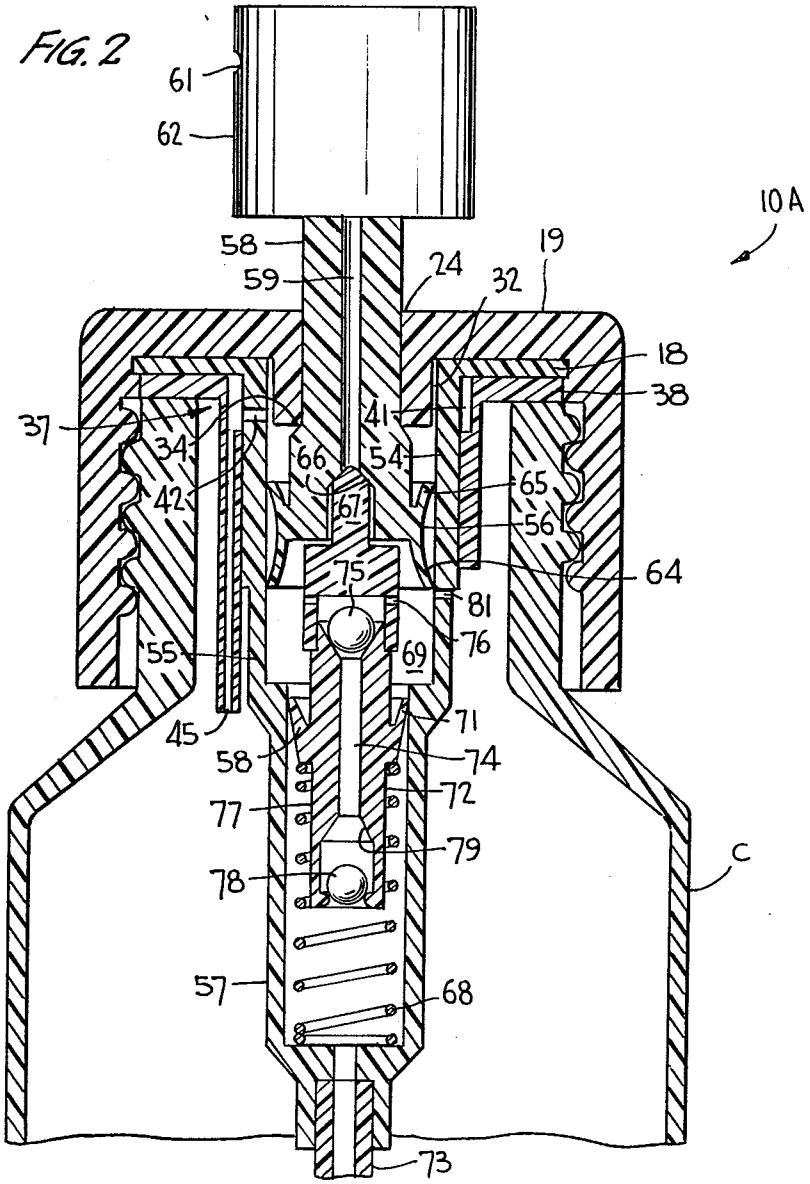
FIG. 2 is a longitudinal sectional view of a manually operated sprayer according to another embodiment of the invention, capable of upright and inverted spray, with an auxiliary valve located within the pump housing.

A pump sprayer is generally designated 10A, in FIG. 2, has the same seal gasket 37 and vent path as in pump sprayer 10 and is mounted on container C in essentialy the same manner. However, this pump sprayer is of the pressure build-up variety similar to that of U.S. Pat. No. 4,051,983, commonly owned herewith. Thus, a pump housing 54 has an upper large diameter pump cylinder 55 with a relatively large diameter pump piston 56 disposed for reciprocation therein, and a relatively smaller diameter pump cylinder 57 having a relatively smaller diameter pump piston 58 disposed for reciprocation therein. A hollow stem 58 of piston 56 extends outwardly through opening 24 of the cap and has a discharge passage 59 formed therein, this passage communicating with a discharge orifice 61 formed in a plunger head 62 mounted on the piston stem. The large diameter pump piston defines a variable volume pump chamber 63 with the large diameter cylinder, and has a pair of oppositely extending sealing lips 64, 65. The inner end of the discharge passage defines a conical valve seat 66 which is normally maintained closed by a discharge valve 67 carried by the small diameter piston for axial movement within hollow rod 58. The discharge valve is normally maintained in its closed and seated position by the resilient thrust of a coil spring 68 compressed between lower piston 58 and the lower end of small diameter cylinder portion 57. However, the discharge valve may be unseated whenever the pressure within the pump housing between the pistons exceeds the thrust of the spring. The two pistons and that part of the two diameter pump housing encompassed between them define a variable volume pump chamber 69.

The small diameter piston 58 has an upwardly directed lip seal 71 and is provided with a hollow piston rod 72 for the reception of liquid product delivered into cylinder 57 through a conventional dip tube 73 carried at the lower end of the pump housing. An intake passage 74 is formed within tube 72 and terminates at its upper end in a valve seat supporting an inlet ball check valve 75 for preventing backflow of liquid product from the pump chamber to the container. The lower end of discharge valve 67 forms a cage for this ball valve and has openings 76 permitting communication between passage 74 and the pump chamber through the open inlet. And, rod 72 has a lower extension 77 with a constricted diameter at its lower end and forming a cage for a ball check valve 78. The upper end of this cage forms a valve seat 79 for ball 78.

And, a bore 81 is formed in the wall of the large diameter cylinder and lies just below lip seal 64 in the at rest position of the piston shown in FIG. 2. Ball valve 78 and its seat, as well as bore 81 as controlled by the large diameter piston, constitute an auxiliary valve means.

Moreover, a protuberance may be formed on the inner wall of the small diameter lower cylinder 57 for deforming piston seal 71 during piston reciprocation so as to form air escape passages so that entrapped air may escape from between the pistons into the lower end of the pump chamber and into the container through the dip tube to be replaced by liquid from the container, all as described in detail in U.S. Pat. No. 4,051,983.

During the operation of the pump sprayer in the upright position of FIG. 2, after the pump is primed, liquid product within the pump chamber is compressed during the inward movement of the large diameter piston so thereby seat ball valve 75 closed, and upon an increase in pressure sufficient to overcome the thrust of spring 68, liquid is transferred from the large diameter upper cylinder into the small diameter lower cylinder whereupon the lower piston will move downwardly at a higher velocity than the upper piston thereby opening the discharge valve. Upon the ensuing upstroke, reduced pressure with the pump chamber unseats ball valve 75 and suctions product from the container up through the dip tube, around ball valve 78 and through passage 74.

In an inverted position of the spray mounted container, product is dispensed during the pump pressure stroke in the same manner as described with reference to the upright position. However, during the ensuing return stroke, ball valve 78 which has fallen by gravity within its cage is sealed closed against its valve seat by the internal differential pressure of the container and pump chamber. And, the reduced pressure within the pump chamber suctions liquid through intake port 81 as valve seal 64 of the large diameter piston uncovers this port. Again, since vent port 45 extends beyond liquid intake port 81, a simultaneous intake of air into the pump chamber through this intake port is avoided during venting of the container.

In each of the sprayers 10 and 10A described above, that quantity of liquid within the container below intake ports 50 and 81 cannot be effectively withdrawn in an inverted position of the containers with these intake ports located above the liquid level. Therefore, a complete withrawal of the liquid content from the container is not made possible for these two embodiments. Each of the remaining embodiments of the invention essentially solves this problem by making it possible to withdraw substantially the entire contents of the liquid from the container while spraying in an inverted position. Pump sprayer 10B, for example, is constructed and functions essentially the same as sprayer 10 of FIG. 1, so that like parts will be designated by like reference numerals.

An auxiliary valve housing 82 of this sprayer is essentially the same as housing 46 in FIG. 1 except that its sleeve 83 has no elongated slot but is rather plugged at its open end by a hollow plug 84 which supports an intake conduit 85 terminating in an intake port 86 closely adjacent the underside of lateral flange 38 of a gasket seal 87.

An insert 88 forming a cage is mounted within housing 82 and contains a ball check valve 89 which seats against its valve seat 90 formed within the cage for preventing air from being ingested into the pump chamber through dip tube 47 in an inverted position of the container. During upright spray, ball valve 89 permits liquid product to be drawn from the container through dip tube 47, as in any normal manner.

The inner diameter of pump cylinder 12 is enlarged at its upper end so as to present an annular gap 91 with sleeve 32 extending just below the lower end thereof, and at least one opening 92 is formed at the inner end of flange 18 of pump cylinder 12 in communication with this annular gap. Skirt 39 of gasket seal 87 has at least one axially extending groove 93 at the inner periphery thereof in communication with opening 92 and a gap 91 so as to thereby define a vent passage into the container together with the annular gap formed between stem 23 and opening 24. The vent passage is shown closed in FIG. 3, and is opened during pump reciprocation in the same manner described in FIG. 1. And, groove 93 terminates in a vent port 94 spaced a greater distance from the underside of flange 38 compared to the spacing of intake port 86 therefrom. Therefore, in an inverted spray position, air bubbles from the open vent path entering the container during pump reciprocation are avoided from simultaneously inletting the pump chamber through intake port 86 which permits essentially the entire contents of the container to be emptied during inverted spray.

Figure 4:
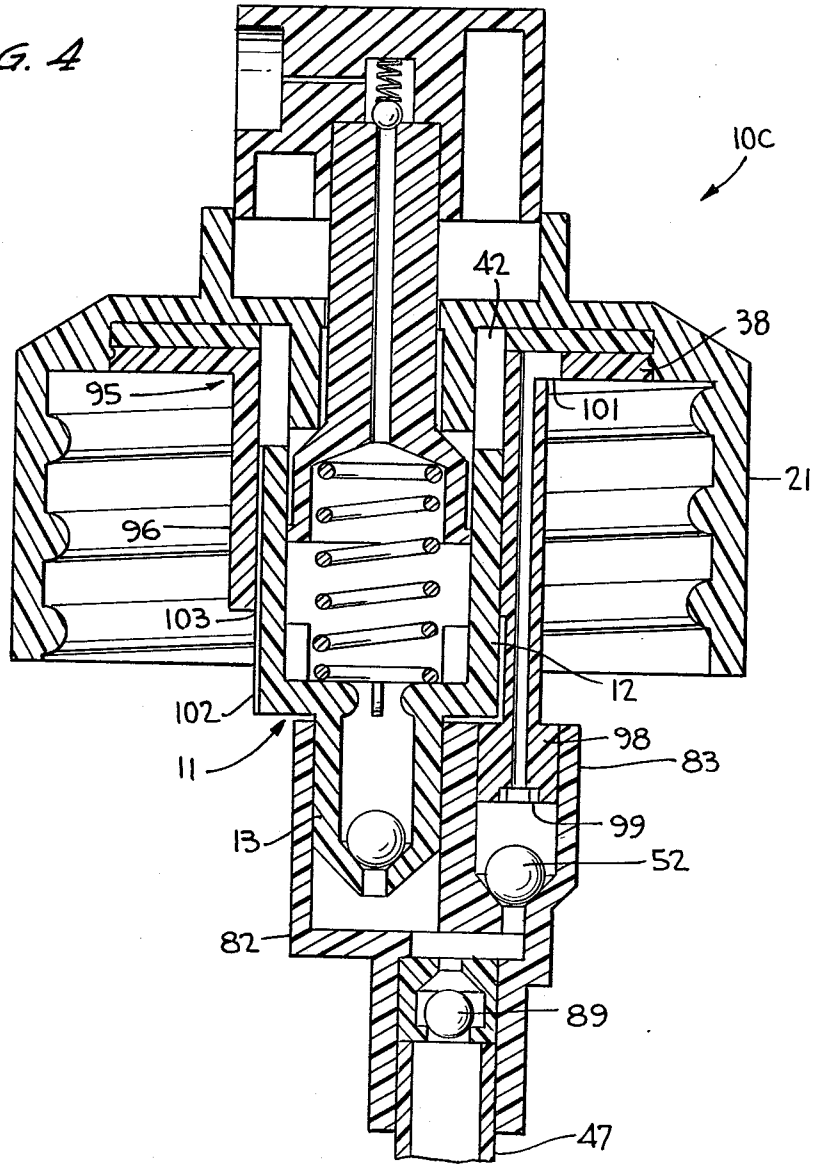
FIG. 4 is a longitudinal sectional view of a manually operated sprayer according to still another embodiment of the invention, capable of operating an inverted spray, with the auxiliary valve external to the pump housing and with a liquid conduit extending through the gasket.

Another pump sprayer embodiment of the invention is generally designated 10C in FIG. 4 and likewise permits substantially the entire contents of the container to be emptied during inverted spray while at the same time avoiding the entry of air bubbles into the pump chamber in such position through the open vent passage. In this construction, a seal gasket 95 has a depending sleeve 96 with an axial bore 97 formed in the wall thereof, and a lower end of the skirt forming a hollow plug 98 fitted within sleeve 83. The terminal end of this plug has webs 99 preventing ball valve 52 from sealing conduit 97 closed in the inverted spray position. And, bore 97 terminates in an intake port 101 formed in flange 38 of the gasket seal.

The air vent passage of this embodiment is formed in part by at least one axial groove 102 formed in the outer periphery of pump cylinder 12, the vent path having a vent port 103 defined by groove 102 and the surrounding skirt 96. This vent port is spaced a greater distance from the underside of flange 38 as compared to the spacing of intake port 97 therefrom. Thus, upright spray is carried out as before, and during inverted spray liquid is suctioned into the pump chamber through intake port 101 without the possibility of the ingestion of any air bubbles from the open vent path into the pump chamber through this intake port.

Figure 5:
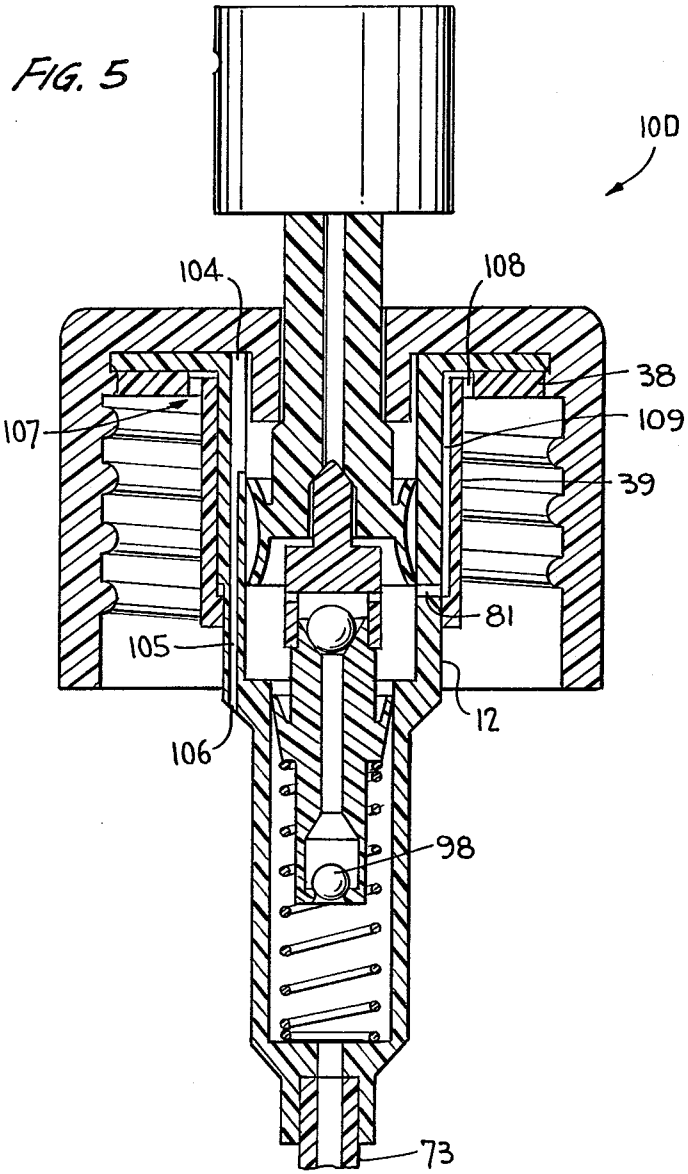
FIG. 5 is a longitudinal sectional view of a manually operated sprayer according to yet another embodiment of the invention, capable of upright and inverted spray, with an auxiliary valve located within the pump housing and with a liquid passage located between the pump housing and a surrounding sleeve of the gasket.

A pump sprayer generally designated 10D in FIG. 5 represents a slight modification over sprayer 10A of FIG. 2. Thus, pump cylinder 12 has an inner groove 104 formed at its upper end, and an axially bore 105 in its wall extending from this groove and terminating in a vent port 106. A seal gasket of this embodiment has at least one bore 108 in its flange 38 forming an intake port, and at least one axial groove 109 formed at the inner periphery of its skirt 39 in communication with bore 81 as well as with port 108. Otherwise, skirt 39 sealingly engages the entire outer periphery of pump cylinder 12 below bore 81, as shown. With such a construction, vent port 106 is located a greater distance from the underside of flange 38 compared to that of intake port 108, and an inverted spray is carried out in the same manner as described in the foregoing embodiment without the ingestion of any air bubbles into the pump chamber.

Figure 3:
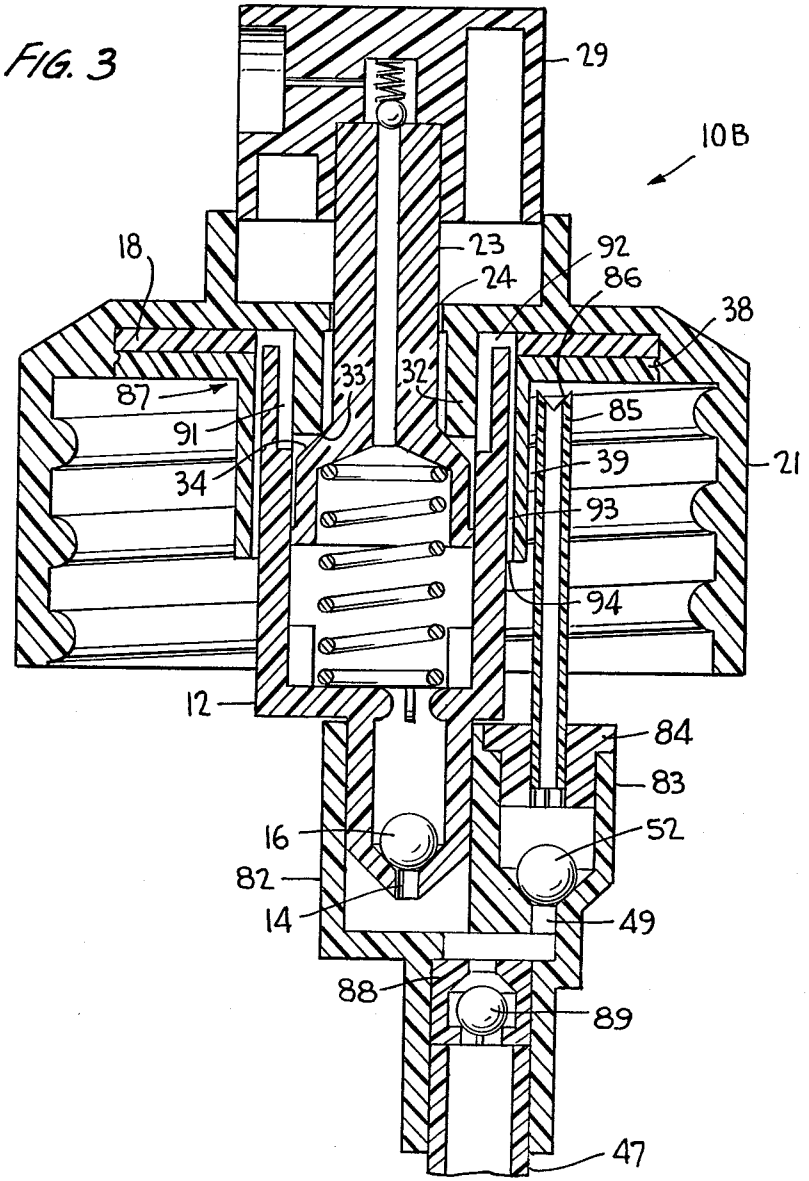
FIG. 3 is a view similar to FIG. 1 of yet another embodiment having an intake conduit for completely emptying the container during inverted spray.
Figure 6:
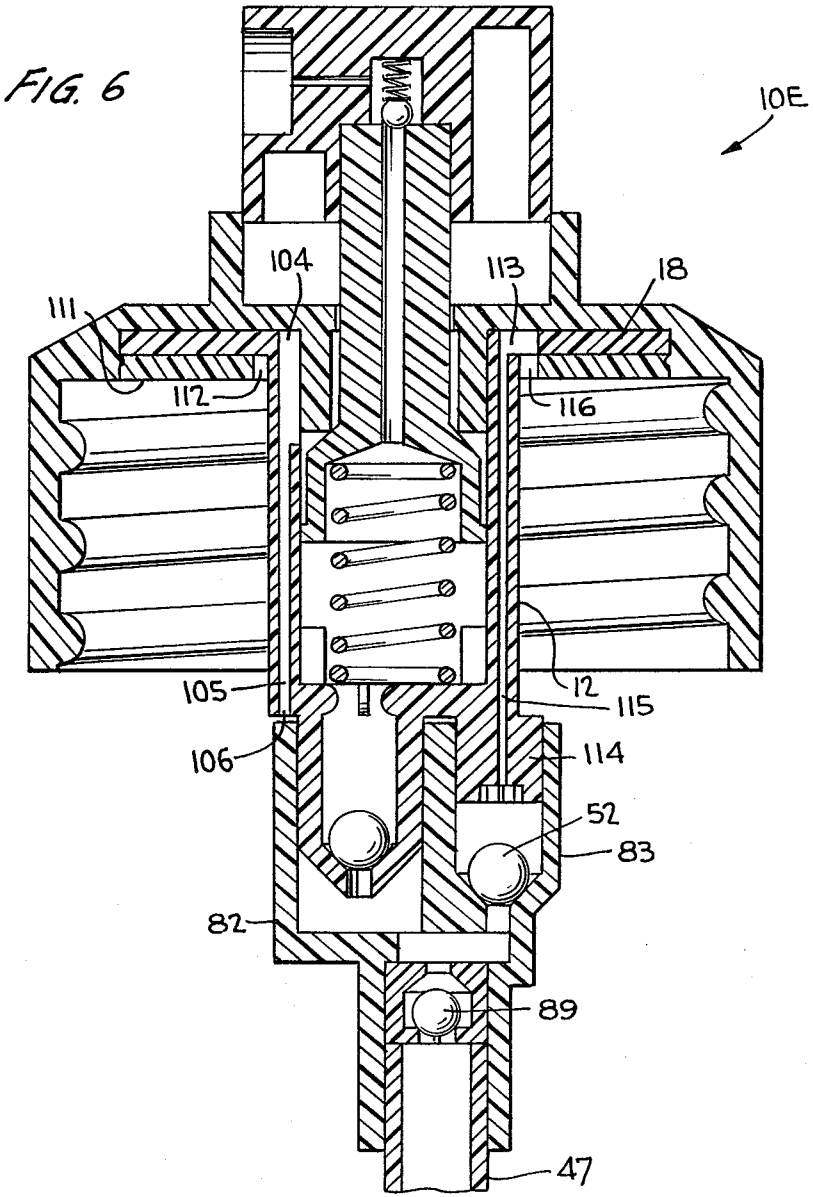
FIG. 6 is a longitudinal sectional view of a manually operated sprayer according to yet another embodiment of the invention, capable of upright and inverted spray, with an auxiliary valve external to the pump housing and with a liquid conduit extending through the wall of the pump housing.

Another embodiment that is shown in FIG. 6 in which sprayer 10E has the same auxiliary valve housing 82 as in FIGS. 3 and 4. And, the pump cylinder has an axial bore and a groove 104 formed in the wall thereof similarly as in FIG. 5.

However, a seal gasket 111 for this embodiment has an enlarged inner diameter forming an annular sleeve 112 with the pump cylinder, and flange 18 of cylinder 12 has an opening 113 formed therein in communcation with this annular gap. And, the lower end of the pump cylinder terminates in a hollow plug 114 extending into sleeve 83 of the auxiliary valve housing, and an axial bore 115 is formed in the wall of cylinder 12 from the open end of its plug 114 and communicating with opening 113 and with the interior of the container so that an intake port 116 is formed in the seal gasket. As before, vent port 106 is spaced a greater distance from the underside of the seal gasket, and the liquid intake port lies within the seal gasket, as in FIGS. 4 and 5. Thus, inverted spray is carried out as before without the possibility of any simultaneous ingestion of air bubbles into the pump chamber through the liquid intake port during pump reciprocation.

Terms of orientation, such as "upper", "under", and the like, are used herein for purposes of clarity to identify the orientation relative to the drawings. Such terms are not intended to limit the scope of this invention or to exclude any equivalent structure.

Obviously, many other modifications and variations of the present invention are made possible in the light of the above teachings. It is therefore to be understood that within the scope of the appended claims the invention may be practiced otherwise than as specifically described.

What is claimed is:

1. A manually operated dispenser comprising:

a pump housing including a pump cylinder;

a manually operated piston reciprocably movable within said cylinder so as to define a pump chamber having a variable volume, said piston having a suction stroke when reciprocably moving in one direction such that said volume of said pump chamber increases and having a pressure stroke when reciprocably moving in a direction opposite to said one direction;

a valve controlled inlet passage leading to said pump chamber;

a closure cap in engagement with said housing for mounting said cylinder on a container of liquid to be dispensed, said piston having a stem extending outwardly through a central opening in said cap, said stem having a valve controlled discharge passage;

a sealing gasket within said cap for sealing against a mouth of the container, said gasket having an underside facing toward a container of liquid to be dispensed when said cylinder is mounted on the container;

means for equalizing a pressure within the container when said cylinder is mounted on the container and including a closable container vent path formed between said piston and said closure cap, said piston and said closure cap being arranged relative to each other so that said container vent path opens and closes by said piston reciprocably moving respectively away from and into contact with said closure cap so that the pressure within the container equalizes when said container vent path is open;

auxiliary valve means associated with said pump chamber and including an intake port through which the liquid is suctioned into said pump chamber when the container is in an inverted position, said intake port being spaced a predetermined distance from said underside of said gasket; and only one air vent port terminating said vent path, said air vent port being spaced from said underside of said gasket at a distance greater than said predetermined distance so that in the inverted position of the container air enters through said air vent port during said suction stroke of said piston and is prevented from entering said pump chamber through said intake port, said piston and said cylinder being arranged in a liquid-tight abutment against one another so that said piston seals off said container vent path from said pump chamber at all times to thereby prevent the liquid from entering the container vent path during said pressure and suction strokes of said piston, said container vent path being free of any additional valve means.

2. The dispenser according the claim 1, wherein said annular gasket has a vent passage terminating in said vent port.

3. The dispenser according to claim 2, wherein said gasket has a sleeve sealingly engaging said cylinder.

4. A manually operated dispenser comprising:

a pump housing including a pump cylinder;

a manually operated piston reciprocably movable within said cylinder so as to define a pump chamber having a variable volume, said piston having a suction stroke when reciprocably moving in one direction such that said volume of said pump chamber increases and having a pressure stroke when reciprocably moving in a direction opposite to said one direction;

a valve controlled inlet passage leading to said pump chamber;

a closure cap in engagement with said housing for mounting said cylinder on a container of liquid to be dispensed, said piston having a stem extending outwardly through a central opening in said cap, said stem having a valve controlled discharge passage;

a sealing gasket within said cap for sealing against a mouth of the container, said gasket having an underside facing toward a container of liquid to be dispensed when said cylinder is mounted on the container;

means for equalizing a pressure within the container when said cylinder is mounted on the container and including a closable container vent path formed between said piston and said closure cap, said piston and said closure cap being arranged relative to each other so that said container vent path opens and closes when said piston reciprocably moves and so that the pressure within the container equalizes when said container vent path is open;

auxiliary valve means associated with said pump chamber and including an intake port through which the liquid is suctioned into said pump chamber when the container is in an inverted position, said intake port being spaced a predetermined distance from said underside of said gasket; and an air vent port terminating said vent path and being spaced from said underside of said gasket at a distance greater than said predetermined distance so that in the inverted position of the container air enters through said air vent port during said suction stroke of said piston and is prevented from entering said pump chamber through said intake port, said piston and said cylinder being arranged in a liquid-tight abutment against one another so that said piston seals off said container vent path from said pump chamber at all times to thereby prevent the liquid from entering the container vent path during said pressure and suction strokes of said piston, said sealing gasket being annular and having a vent passage terminating in said vent port and having an axial tube defining said vent passage.

5. The dispenser according to claim 3, wherein the inner wall of said sleeve has at least one axially extending groove defining said vent passage.

6. The dispenser according to claim 3, wherein the outer wall of said cylinder has at least one axially extending groove defining said vent passage.

7. The dispenser according to claim 1, wherein said vent path is defined by an axial vent passage in the wall of said cylinder.

8. The dispenser according to claim 1, wherein said piston is movable to a postion corresponding to an end of the suction stroke, said intake port being located closer to said underside of said gasket than is said piston at the end of said suction stroke.

9. A manually operated dispenser comprising:

a pump housing including a pump cylinder;

a manually operated piston reciprocably movable within said cylinder so as to define a pump chamber having a variable volume, said piston having a suction stroke when reciprocably moving in one direction such that said volume of said pump chamber increases and having a pressure stroke when reciprocably moving in a direction opposite to said one direction;

a valve controlled inlet passage leading to said pump chamber;

a closure cap in engagement with said housing for mounting said cylinder on a container of liquid to be dispensed, said piston having a stem extending outwardly through a central opening in said cap, said stem having a valve controlled discharge passage;

a sealing gasket within said cap for sealing against a mouth of the container, said gasket having an underside facing toward a container of liquid to be dispensed when said cylinder is mounted on the container;

means for equalizing a pressure within the container when said cylinder is mounted on the container and including a closable container vent path formed between said piston and said closure cap, said piston and said closure cap being arranged relative to each other so that said container vent path opens and closes when said piston reciprocably moves and so that the pressure within the container equalizes when said container vent path is open;

auxiliary valve means associated with said pump chamber and including an intake port through which the liquid is suctioned into said pump chamber when the container is in an inverted position, said intake port being spaced a predetermined distance from said underside of said gasket; and an air vent terminating said vent path and being spaced from said underside of said gasket at a distance greater than said predetermined distance so that in the inverted position of the container air enters through said air vent port during said suction stroke of said piston and is prevented from entering said pump chamber through said intake port, said piston and said cylinder being arranged in a liquid-tight abutment against one another so that said piston seals off said container vent path from said pump chamber at all times to thereby preent the liquid from entering the container vent path during said pressure and suction strokes of said piston, said sealing gasket being annular and having a lateral flange for sealing against the mouth of the container, said flange containing said intake port, said gasket having a sleeve surrounding said cylinder, said auxiliary valve means including a valve housing, said sleeve being connected to said valve housing and having a bore in the wall thereof leading from said valve housing and terminating in said intake port.

10. The dispenser according to claim 1, wherein said annular gasket has a lateral flange for sealing against the mouth of the container, said flange containing said intake port, the wall of said cylinder having a bore, said gasket having a sleeve in sealing engagement about said cylinder beneath said bore thereof, said sleeve having a passage connecting said bore with said intake port.

11. The dispenser according to claim 1, wherein said annular gasket has a lateral flange for sealing against the mouth of the container, said auxiliary valve means including a valve housing, said pump cylinder having a liquid passage extending from said valve housing and terminating in said intake port.

12. A manually operated sprayer, comprising:

a pump housing including a pump cylinder;

a manually operated piston reciprocable within said cylinder to have a plurality of suction strokes and defining a variable volume pump chamber with said cylinder;

a valve controlled inlet passage leading to said chamber;

a closure cap in engagement with said housing for mounting said cylinder on a container of liquid to be dispensed, said piston having a stem extending outwardly through a central opening in said cap, said stem having a valve controlled discharge passage;

a sealing gasket within said cap for sealing against a mouth of the container, said gasket having an underside facing toward a container of liquid to be dispensed when said cylinder is mounted on the container, the dispenser having a container vent path controlled by said piston upon reciprocation;

auxiliary valve means associated with said pump chamber including an intake port through which the liquid is suctioned into said pump chamber when the container is in an inverted position, said intake port being spaced a predetermined distance from asid underside of said gasket, and said vent path terminating at an air vent port spaced from said underside of said gasket a greater distance than said predetermined distance, whereby in the inverted position of container air entering through said air vent port during said suction strokes of said piston is prevented form inletting said pump chamber through said intake port, said gasket being annular and having a lateral flange for sealing against the mouth of the container, said flange containing said intake port, said gasket having a sleeve surrouding said cylinder, said auxiliary valve means including a valve housing, said sleeve being connected to said valve housing and having a bore in a wall thereof leading from said valve housing and terminating in said intake port.

13. A manually operated sprayer, comprising:

a pump housing including a pump cylinder;

a manually operated piston reicprocable within said cylinder to have a plurality of suction strokes nd defining a variable volume pump chamber with said cylinder;

a valve controlled inlet passage leading to said chamber;

a closure cap in engagement with said housing for mounting said cylinder on a container of liquid to be dispensed, said piston having a stem extending outwardly through a central opening in said cap, said stem having a valve controlled discharge passage;

a sealing gasket within said cap for sealing against a mouth of the container, said gasket having an underside facing toward a container of liquid to be dispensed when said cylinder is mounted on the container, the dispenser having a container vent path controlled by said piston upon reciprocation;

auxiliary valve means associated with said pump chamber including an intake port through which the liquid is suctioned into said pump chamber when the container is in an inverted position, said intake port being spaced a predetermined distance from said underside of said gasket, and said vent path terminating at an air vent port spaced from said underside of said gasket a greater distance than said predetermined distance, whereby in the inverted position of container air entering through said air vent port during said suction strokes of said piston is prevented from inletting said pump chamber through said intake port, said gasket being annular and having a lateral flange for sealing against the mouth of the container, said flange containing said intake port, said cylinder having a bore, said gasket having a sleeve in sealing engagement about said cylinder beneath said bore thereof, said sleeve defining a passage connecting said bore with said intake port.

14. The dispenser according to claim 1, wherein said auxiliary valve means is arranged within said cylinder.

15. The dispenser according to claim 1, wherein said valve controlled outlet passage includes a ball check valve, said ball check valve being spring biased into a closed position in which said inlet passage is closed.

16. The dispenser according to claim 1, wherein said auxiliary valve means includes a valve housing and a conduit, said conduit extending from said valve housing and terminating at said intake port.

17. The dispenser according to claim 1, wherein said valve housing includes a hollow plug supporting said conduit.

* * * * *